US005324093A

United States Patent [19]

Sugiyama

[11] Patent Number: 5,324,093

[45] Date of Patent: Jun. 28, 1994

[54] APPARATUS FOR SETTING OPERATIVE ATTITUDE OF FURNITURES IN FURNITURE RAISING/LOWERING TYPE FLOOR EQUIPMENT

[75] Inventor: Noboru Sugiyama, Tokyo, Japan

[73] Assignee: Kabushiki Kaisha Kotobuki, Tokyo, Japan

[21] Appl. No.: 813,860

[22] Filed: Dec. 26, 1991

[30] Foreign Application Priority Data

Dec. 27, 1990 [JP] Japan ..... 2-406910

[51] Int. Cl.[5] ..... A47C 9/06

[52] U.S. Cl. ..... 297/15; 52/9

[58] Field of Search ..... 297/15, 232, 338, 345; 52/9, 10, 8

[56] References Cited

U.S. PATENT DOCUMENTS 895,552 8/1908 Gehrke ..... 297/15
3,142,871 8/1964 Harms ..... 52/10
4,854,092 8/1989 Chatenay épouse ..... 52/9 X

FOREIGN PATENT DOCUMENTS 573115 6/1924 France ..... 297/15
2318605 7/1975 France .
115662 5/1991 Japan ..... 52/8

*Primary Examiner*—Laurie K. Cranmer
*Attorney, Agent, or Firm*—Oldham, Oldham & Wilson Co.

[57] ABSTRACT

An apparatus for setting an operative attitude to be assumed by each furniture such as a chair, a table or the like in a furniture accommodating chamber of a furniture raising/lowering type floor equipment is disclosed. The apparatus includes as essential components a raising/lowering unit vertically displaceably accommodated in the furniture accommodating chamber and having an array of furnitures mounted thereon so as to allow the furnitures to assume a raised-up attitude or an accommodated attitude, first and second cam guide rails arranged in the furniture accommodating chamber while standing upright therein so as to assure that the furnitures firmly maintain a raised-up attitude or an accommodated attitude, and a triangular link mechanism operatively associated with the raising/lowering unit and operatively connected to the furnitures so as to enable the furnitures to assume a raised-up attitude or an accommodated attitude.

10 Claims, 6 Drawing Sheets

APPARATUS FOR SETTING OPERATIVE ATTITUDE OF FURNITURES IN FURNITURE RAISING/LOWERING TYPE FLOOR EQUIPMENT

BACKGROUND OF THE INVENTION

1. Field of the Invention

The present invention relates generally to an apparatus for setting an operative attitude to be assumed by each furniture to be accommodated in a furniture accommodating chamber of a furniture raising/lowering type floor equipment wherein a plurality of furnitures such as chairs, tables or the like mounted for a building such as a hall, a theater, a gymnasium or the like are accommodated in the furniture accommodating chamber when they are not in use. More particularly, the present invention relates to an apparatus of the foregoing type wherein the apparatus assures that the operative attitude to be assumed by each furniture can be set automatically.

2. Description of the Related Art

In recent years, a variety of research and development works have been earnestly conducted for providing a various kinds of floor equipments so as to meet the requirement for multi-purposed utilization of a building such a hall, a theater, a gymnasium or the like. As is well known, the foregoing kind of floor equipments are generally classified into an expansible/contractible type floor equipment and a raising/lowering type floor equipment. The present invention is concerned with the latter type of floor equipment. Most of this type of conventional floor equipments are usually constructed such that an array of, e.g., chairs (jointed to each other in the side-by-side relationship) are mounted on the floor surface of the building so as to allow each audience to enjoy a performance while sitting on his chair. However, when the performance is over, each chair becomes merely a kind of obstacle. To avoid this inconvenience, many conventional furniture raising/lowering type floor equipments have been constructed such that the chairs mounted on the floor surface of the building are flatly folded when they are not in use, and they are then accommodated together with their feet in a chair accommodating chamber below the floor surface of the building. When the chairs are to be in use, they are taken out of the chair accommodating chamber and then unfolded to stand upright on the floor surface of the building.

With each of the conventional raising/lowering type floor equipments constructed in the above-described manner, when the chairs are to be in use, the chairs which have been accommodated in the chair accommodating chamber are raised up therefrom and then unfolded and inclined in the rearward direction together with back rests. On the contrary, when the chairs are to be not in use, they are flatly folded and then accommodated again in the chair accommodating chamber. However, such folding and unfolding operations as mentioned above are very complicated and time-consuming. In addition, there is a need of firmly holding the chairs while maintaining their correct operative attitude but few attention has been hitherto paid to a mechanism for allowing the respective chairs to maintain their correct operative attitude not only when they are practically used on the floor surface of the building but also when they are not in use.

SUMMARY OF THE INVENTION

The present invention has been made with the foregoing background in mind.

An object of the present invention is to provide an apparatus for setting an operative attitude to be assumed by furnitures such as chairs, tables or the like to be accommodated in a furniture accommodating chamber of a raising/lowering type floor equipment wherein the apparatus assures that an operations for allowing each furniture to assume an operative attitude can automatically be performed not only when they are practically used on the floor surface of a building such as hall, a theater, a gymnasium or the like but also when they are accommodating in the furniture accommodating chamber below the floor surface of the same.

Another object of the present invention is to provide an apparatus for setting an operative attitude to be assumed by furnitures such as chairs, tables or the like to be accommodated in a furniture accommodating chamber of a raising/lowering type floor equipment wherein the apparatus assures that the respective furnitures can be folded and unfolded easily.

According to a first aspect of the present invention, there is provided an apparatus for setting an operative attitude to be assumed by each furniture in the form of a chair in a furniture accommodating chamber of a furniture raising/lowering type floor equipment, wherein the apparatus comprises a raising/lowering unit vertically displaceably accommodated in the furniture accommodating chamber and having an array of chairs mounted thereon via support rods so as to allow the chairs to assume a raised-up attitude or an accommodated attitude, first and second guide rails arranged in the furniture accommodating chamber while standing upright therein so as to assure that the chairs firmly maintain a raised-up attitude or an accommodated attitude, and a triangular link mechanism operatively associated with the raising/lowering unit and operatively connected to the chairs via the support rods so as to enable the chairs to assume a raised-up attitude or an accommodated attitude.

In the case where chairs are used as furnitures, the triangular link mechanism comprises a first link integrated with the lower end of each support rod having a chair mounted thereon and including a roller at the foremost end thereof, a second link pivotally connected to the first link to serve as an intermediate link and third links pivotally connected to the second link and including rollers at the foremost ends thereof wherein the third links are adapted to turn about a shaft transversely projecting from the raising/lowering unit at the intermediate positions thereof.

The first cam guide rail serves as a main cam guide rail and includes an inclined surface in the vicinity of the upper end thereof, a projection surface extending upward of the inclined surface and a recessed surface extending downward of the inclined surface. On the other hand, each of the second cam guide rails serves as an auxiliary cam guide rail and includes an inclined surface substantially corresponding the inclined surface of the first cam guide rail, a projection surface extending downward of the inclined surface and a recessed surface extending upward of the inclined surface.

The first guide rail is located in alignment with the first link integrated with the lower end of each support rod having a chair mounted thereon and the second cam guide rails are located in alignment with the third links.

Thus, when chairs are not in use, the respective chairs are vertically folded and accommodated in the furniture accommodating chamber while the roller at the foremost end of the first link is received in the recessed surface of the first cam guide rail and the rollers at the foremost ends of the third links are engaged with the projection surfaces of the second cam guide rails so as to enable the respective chairs to maintain an accommodated attitude. On the other hand, when they are in use, they are unfolded and stand upright on the floor surface of a building while the roller of the first lever is engaged with the projection surface of the first cam guide rail and the rollers of the third links are received in the recessed surfaces of the second cam guide rails so as to enable the respective chairs to maintain a raised-up attitude.

As the raising/lowering unit is raised up in the furniture accommodating chamber, the third link turns about the shaft transversely projecting from the raising/lowering unit, whereby the support rod rearwardly turns about a shaft located at the intermediate position thereof via the second link and the first link until each chair assumes an inclined state.

In addition, according to a second aspect of the present invention, there is provided an apparatus for setting an operative attitude to be assumed by each furniture in the form of a table in a furniture accommodating chamber of a furniture raising/lowering type floor equipment, wherein the apparatus comprises a raising/lowering unit vertically displaceably accommodated in the furniture accommodating chamber and having an array of tables mounted thereon so as to allow the tables to assume a raised-up attitude or an accommodated attitude, first and second cam guide rails arranged in the furniture accommodating chamber while standing upright therein so as to assure that the tables firmly maintain a raised-up attitude or an accommodated attitude, and a triangular link mechanism operatively associated with the raising/lowering unit and operatively connected to the tables via connecting rods so as to enable the tables to assume a raised-up attitude or an accommodated attitude.

In the case where tables are used as furnitures, the triangular link mechanism comprises first links turnable arranged to turn about a shaft transversely projecting from the raising/lowering unit and including rollers at the foremost ends thereof, a second link turnably arranged below the first links to turn about the shaft and including a roller at the foremost end thereof and a third link bridged between the first links and and the second link to serves as a joint link wherein the upper end of the third link is pivotally connected to the lower end of each connecting rod for each table at the intermediate positions of the first links where the third link is pivotally connected to the first links.

The first cam guide rail serves as a main cam guide rail and includes a projection surface in the region in the vicinity of the upper end thereof, a stepped portion positionally coinciding with the lower end of the projection surface and a recessed surface extending downward of the stepped portion. On the other hand, each of the second cam guide rails serves as an auxiliary cam guide rail and includes a recessed surface in the region in the vicinity of the upper end thereof, a stepped portion positionally coinciding with the lower end of the recessed surface and a projection surface extending downward of the stepped portion.

The first cam guide rail is located in alignment with the second link and the second cam guide rails are located in alignment with the first links. Thus, when tables each including a table plate are not in use, the respective table plates are vertically folded and accommodated in the furniture accommodating chamber while the rollers at the foremost ends of the first links are engaged with the projection surfaces of the second cam guide rails and the roller at the foremost end of the second link is received in the recessed surface of the first cam guide rail so as to enable the respective tables to maintain an accommodated attitude. On the other hand, when they are in use, the respective table plates are unfolded with the aid of the connecting rod and the respective tables stand upright on the floor surface of a building while the rollers of the first links are received in the recessed surfaces of the second cam guide rails and the roller of the second link is engaged with the projection surface of the second cam guide rail so as to enable the respective tables to maintain a raised-up attitude.

As the raising/lowering unit is raised up in the furniture accommodating chamber, the first links and the second link turn about the shaft transversely projecting from the raising/lowering unit, whereby the connecting rod is increasingly raised up via the third link of which upper end positionally coincides with the intermediate positions of the first links until the respective table plates assume a horizontal orientation by turning movement thereof about a shaft transversely projecting from each table wherein the turning movement of the table plates is achieved by a first lever of which one end is pivotally connected to the upper end of the connecting rod and of which other end is pivotally connected to the base end of the table plate, in cooperation with a second lever of which one end is pivotally connected to the upper end of the connecting rod and of which other end is pivotally connected to the upper end of a main body of the table.

Other objects, features and advantages of the present invention will become apparent from reading of the following description which has been made in conjunction of the accompanying drawings.

BRIEF DESCRIPTION OF THE DRAWINGS

The present invention is illustrated in the following drawings in which.

DESCRIPTION OF THE PREFERRED EMBODIMENTS

Figure 1:
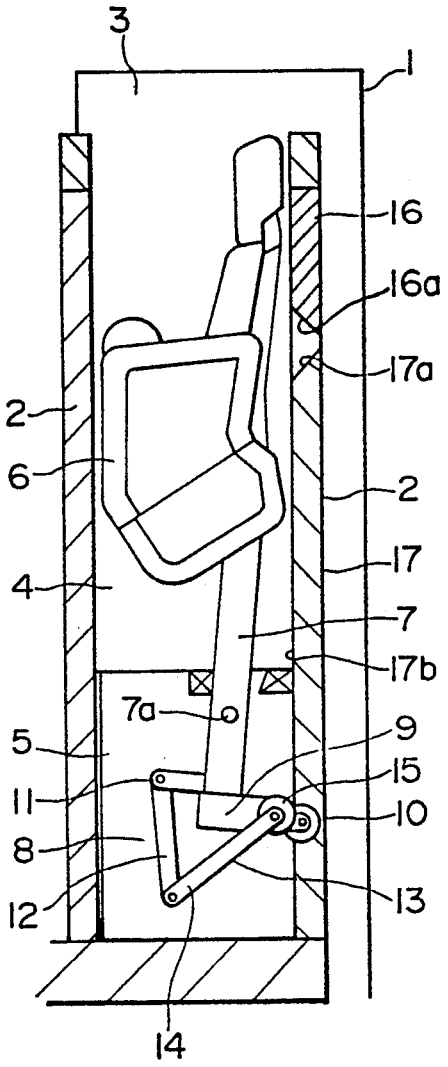
FIG. 1 is a vertical sectional side view of an apparatus for setting an operative attitude to be assumed by chairs to be accommodated in a chair accommodating chamber of a furniture raising/lowering type floor equipment in accordance with a first embodiment of the present invention.

Now, the present invention will be described in detail hereinafter with reference to the accompanying drawings which illustrate preferred embodiments of the present invention.

FIG. 1 to FIG. 7 illustrates an apparatus for setting an operative attitude to be assumed by each chair to be accommodated in a chair accommodating chamber of a furniture raising/lowering type floor equipment in accordance with a first embodiment of the present invention.

In the drawings, reference numeral 1 designates a floor platform which is arranged on the floor surface of a building such as a hall, a theater, a gymnasium or the like. A chair accommodating chamber 4 having an opening portion 3 at the upper surface of the floor platform 1 and defined by frames 2 standing upright therein is formed downward of the floor surface of the building.

Reference numeral 5 designates a raising/lowering unit. An array of foldable chairs 6 (only one chair shown in the drawings) are pivotally mounted on support rods 7*a*to turn about a shaft 7*a* extending across the raising/lowering unit 5, and the raising/lowering unit 5 is vertically displaced in the chair accommodating chamber 4 by activating a driving unit (not shown) so that the chairs 6 are raised up to stand upright on the floor surface thereby to assume a raised-up attitude and lowered to assume an accommodated attitude.

Reference numeral 8 designates a link mechanism which is arranged in association with the raising/lowering unit 5. A part of the link mechanism 8, i.e., a main arm 9 is projected rightward of the lower end of the support rod 7 such that a roller 10 is rotatably supported at the foremost end of the main arm 9. In addition, a projection piece 11 is projected leftward of the lower end of the support rod 7 so that the upper end of a joint piece 12 is pivotally jointed to the foremost end of the projection piece 11. The lower end of the joint piece 12 is pivotally jointed to the left-hand ends of auxiliary arms 13. The intermediate parts of the auxiliary arms 13 are pivotally connected to the raising/lowering unit 5 so that the auxiliary arms 13 turn about a shaft 14, and rollers 15 are rotatably supported at the right-hand ends of the auxiliary arms 13.

Figure 2:
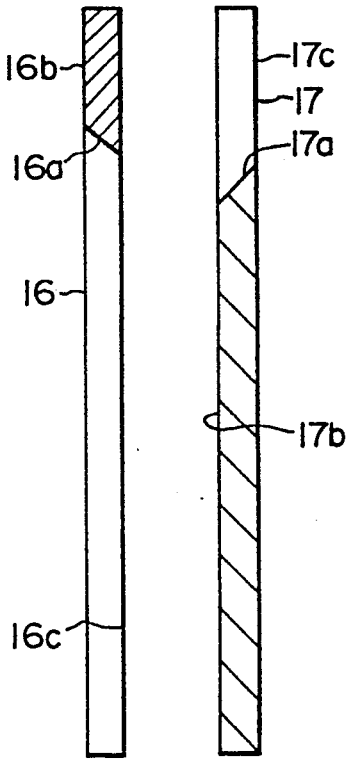
FIG. 2 is a vertical sectional side view of first and second cam guide rails for the apparatus shown in FIG. 1.
Figure 3:
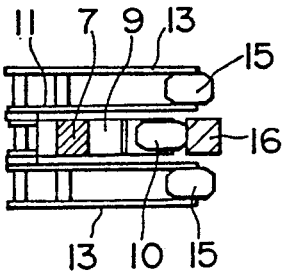
FIG. 3 is a cross-sectional plan view of both the cam guide rails, particularly illustrating an operational relationship between both first and second arms and both the cam guide rails while chairs assume an accommodated attitude.
Figure 4:
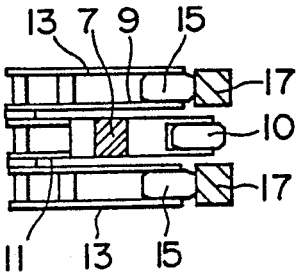
FIG. 4 is a cross-sectional plan view of both the cam guide rails, particularly illustrating the operative relationship between both the first and second arms and both the cam guide rails while the chairs assume a raised-up attitude.

Reference numeral 16 designates a main cam guide rail which is arranged in the rear frame 2. Auxiliary cam guide rails 17 are arranged on the opposite sides of the main cam guide rail 16 which is located therebetween. As shown in FIG. 2, the main cam guide rail 16 is formed with an inclined surface 16*a* in the vicinity of the upper end thereof and includes a projection surface 16*b* extending from the inclined surface 16*a* to the upper end thereof as well as a recessed surface 16*c* extending downward of the inclined surface 16*a*. On the other hand, each auxiliary cam guide rail 17 is formed with an inclined surface 17*a* substantially corresponding to the inclined surface 16*a* of the main cam guide rail 16 and includes a projection surface 17*b* extending downward of the inclined surface 17*a* as well as a recessed surface 17*c* extending upward of the inclined surface 17*a* to the upper end thereof.

With the apparatus constructed in the above-described manner, when the chairs 6 are not in use, they are downwardly folded and accommodated in the chair accommodating chamber 4, as shown in FIG. 1. At this time, the roller 10 of the main arm 9 is received in the recessed surface 16*c* of the main cam guide rail 16, while the rollers 15 of the auxiliary cam guide rails 17 come in contact with the projection surfaces 17*b* of the auxiliary cam guide rails 17.

Figure 5:
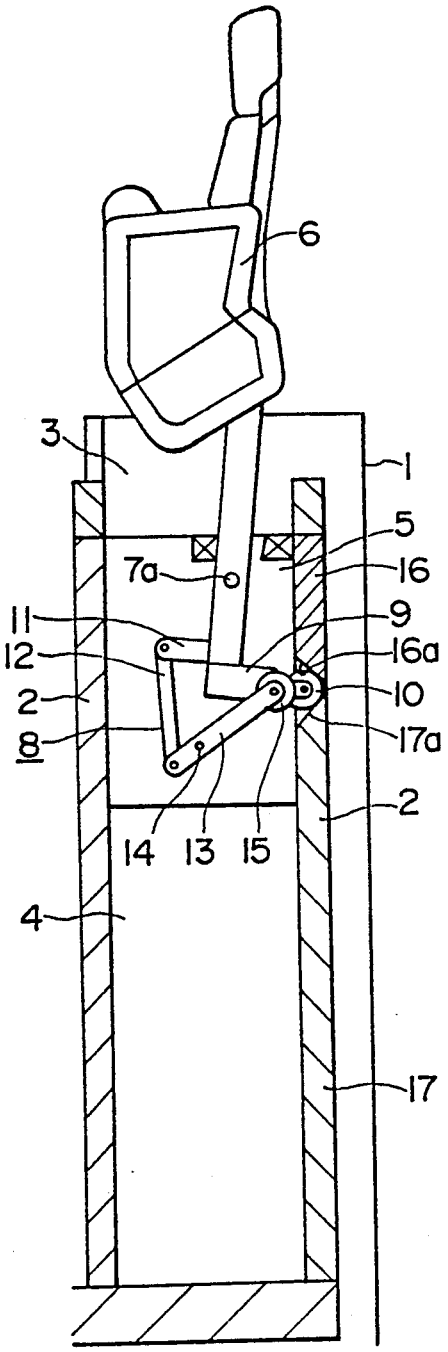
FIG. 5 is a vertical sectional side view of the apparatus, particularly illustrating that a raising/lowering unit is increasingly raised up.

When the chairs 6 are to be raised up from the aforementioned positional state to assume a raised-up attitude, the raising/lowering unit 5 is first activated to raised up. This causes the roller 10 of the main arm 9 to be raised up while rolling on the projection surface 16*c* of the main cam guide rail 16. At the same time, the rollers 15 of the auxiliary arms 13 are likewise raised up while rolling on the projection surfaces 17*b* of the auxiliary cam guide rails 17. When the raising/lowering unit 5 is raised up in the vicinity of the upper end of the chair accommodating chamber 4, the chairs 6 are raised up above the opening portion 3 of the chair accommodating chamber 4. At this time, as shown in FIG. 5, the roller 10 of the main arm 9 reaches the inclined surface 16*a* of the main cam guide rail 16, while the rollers 15 of the auxiliary arms 13 climb over the inclined surfaces 17*a* of the auxiliary cam guide rails 17. As the raising/lowering unit 5 is raised up further, the roller 10 of the main arm 9 is raised up away from the inclined surface 16*a* while rolling on the projection surface 16*b*, causing the main arm 9 to squeeze the support rod 7 in the upward direction thereby to incline the chair 6 about the shaft 7*a* in the rearward direction. At the same time, the link mechanism 8 is actuated by the main arm 9 such that the auxiliary arms 13 turn about the support shaft 14 via the projection piece 11 and the joint piece 12, whereby the rollers 15 rotatably supported at the foremost ends of the auxiliary arms 13 are received in the recessed surfaces 17*c* of the auxiliary cam guide rails 17.

Figure 6:
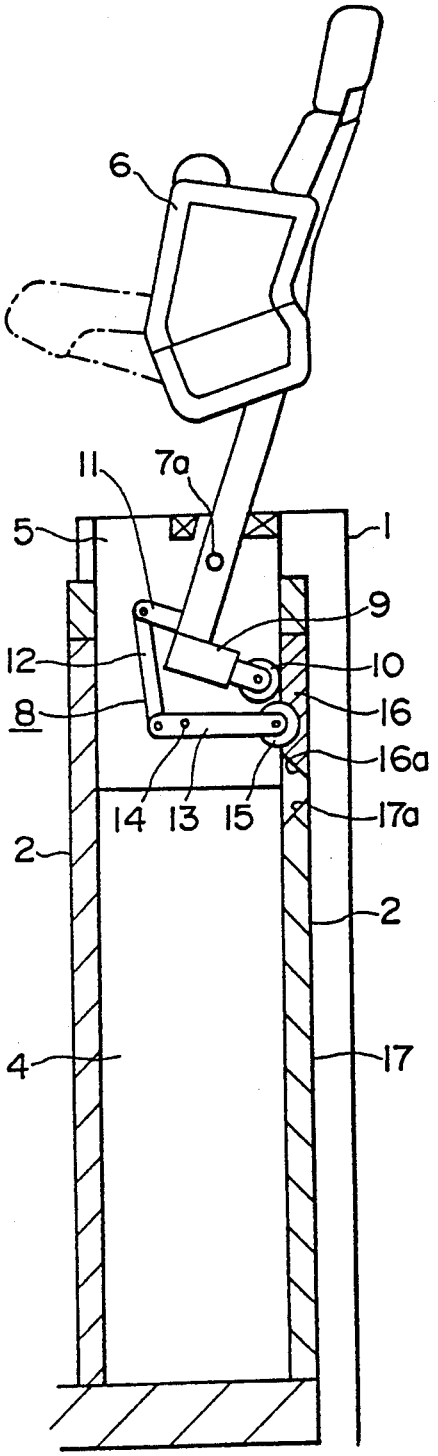
FIG. 6 is a vertical sectional side view of the apparatus, particularly illustrating that the chairs assumes a raised-up attitude.

Thus, the chair 6 has been set to assume a raised-up attitude as shown in FIG. 6.

Figure 7:
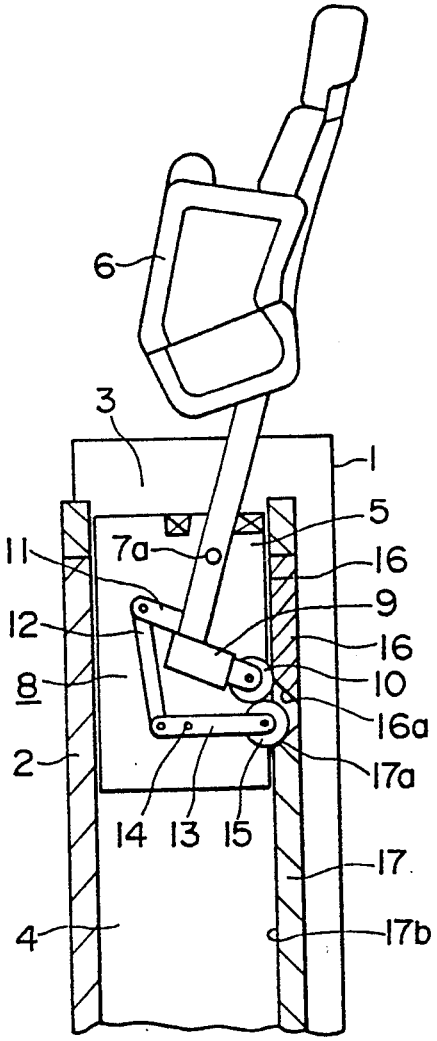
FIG. 7 is a vertical sectional side view of the apparatus, particularly illustrating that the raising/lowering unit is increasingly lowered.

On the contrary, when the chairs 6 are to be accommodated in the chair accommodating chamber 4 while assuming a raised-up attitude, operations are performed in conformity with the reverse order to the aforementioned one so that the raising/lowering unit 5 is lowered in the chair accommodating chamber 4. At this time, as shown in FIG. 7, the rollers 15 of the auxiliary arms 13 climb over the inclined surfaces 17*b* away from the recessed surfaces 17*c* and move down on the projection surfaces 17*b* in operative association with downward displacement of the raising/lowering unit 5 so that the link mechanism 8 is actuated with the shaft 14 serving as a fulcrum. This causes the chair 6 to be turned about the shaft 7*a* in the forward direction to shift from the raised-up attitude toward an accommodated attitude. The roller 10 of the main arm 9 integrated with the support rod 7 rolls down along the inclined surface 16*a* of the main cam guide rail 16 to be received on the recessed surface 16*c*. As a result, the chair 6 can be accommodated in the chair accommodated chamber 4 while maintaining an accommodated attitude as shown in FIG. 1.

FIG. 8 to FIG. 14 illustrate an apparatus for setting an operative attitude to be assumed by each table to be accommodated in a table accommodating chamber of a furniture raising/lowering type floor equipment in accordance with a second embodiment of the present invention.

Also in this embodiment, a table accommodating chamber 24 having an opening portion 23 at the upper surface thereof is formed in the hollow space defined by frames 22 standing upright in a floor platform 21 in the same manner as the first embodiment of the present invention. A raising/lowering unit 25 having an array of tables 26 (only one table shown in the drawings) mounted thereon is received in the table accommodating chamber 24 such that a table plate 27 adapted to turn about a shaft 28 is downwardly folded in the table accommodating chamber 24 to assume an accommodated attitude.

Reference numeral 29 designates a link mechanism which includes a first arm 30 and a second arm 31 which in turn are pivotally connected to each other via a shaft 32. The intermediate parts of both the arms 30 and 31 are pivotally connected to each other via a joint lever 33. A roller 34 is rotatably supported on the foremost end of the first arm 30, while a roller 35 is rotatably supported at the foremost end of the second arm 31. The lower end of a connecting rod 36 is pivotally connected to the intermediate part of the second arm 31 in operative association with the joint lever 33, while the upper end of the connecting rod 36 is pivotally connected to one end of a flattened V-shaped first lever 37 of which other end is pivotally connected to the foremost end of the table plate 27 as well as to one end of a second lever 38 of which other end is pivotally connected to the upper end of a main body of the table 26.

Figure 9:
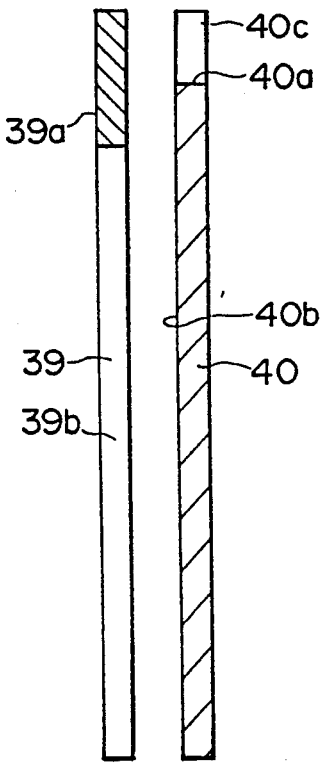
FIG. 9 is a vertical sectional side view of first and second cam guide rails for the apparatus shown in FIG. 8.
Figure 10:
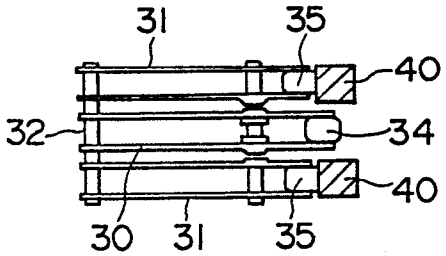
FIG. 10 is a cross-sectional plan view of both the cam guide rails, particularly illustrating an operational relationship between both first and second arms and both the cam guide rails while a table assumes an accommodated attitude.
Figure 11:
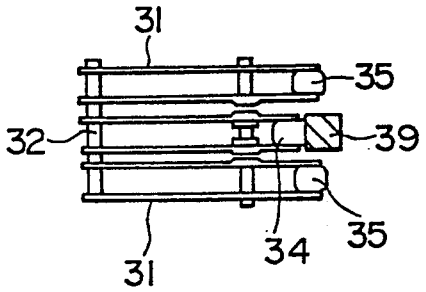
FIG. 11 is a cross-sectional plan view of both the cam guide rails, particularly illustrating the operational relationship between both the rams and both the cam guide rails while the tables assume a horizontal attitude.

Reference numeral 39 designates a first cam guide rail which is arranged in the rear frame 22 of the table accommodating chamber 24. In addition, second cam guide rails 40 are arranged on the opposite sides of the first cam guide rail 39 which is located therebetween. As shown in FIG. 9, the first guide rail 39 includes a projection surface 39*a* in the vicinity of the upper end thereof, and moreover, it is formed with a recessed surface 39*b* extending downward of the projection surface 39*a*. On the other hand, each second cam guide rail 40 is formed with a stepped portion 40*a* at the position substantially corresponding to the projection surface 39*a* of the first cam guide rail 39 and includes a projection surface 40*b* extending downward of the stepped portion 40*a*. In addition, each second cam guide rail 40 is formed with a recessed surface 40*c* extending upward of the stepped portion 40*a*.

Figure 8:
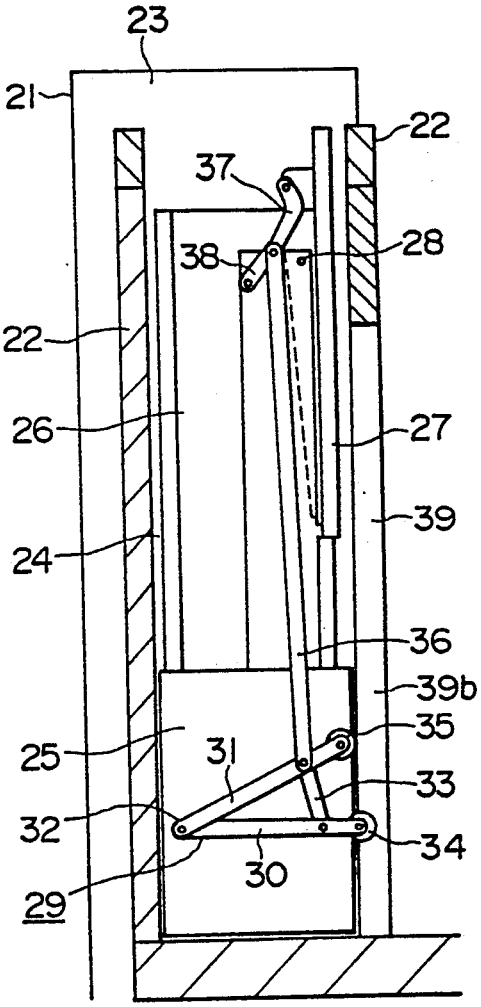
FIG. 8 is a vertical sectional side view of an apparatus for setting an operative attitude to be assumed by tables to be accommodated in a table accommodating chamber of a furniture raising/lowering type floor equipment in accordance with a second embodiment of the present invention, particularly illustrating an accommodated attitude.

With the apparatus constructed in the above-described manner, when the tables 26 are not in use, they are downwardly folded and accommodated in the table accommodating chamber 24, as shown in FIG. 8. At this time, the roller 34 is received in the recessed surface 39*b* of the first cam guide arm 39, while the rollers 35 of the second rams 31 come in contact with the projection surfaces 40*b* of the second cam guide rails 40.

Figure 12:
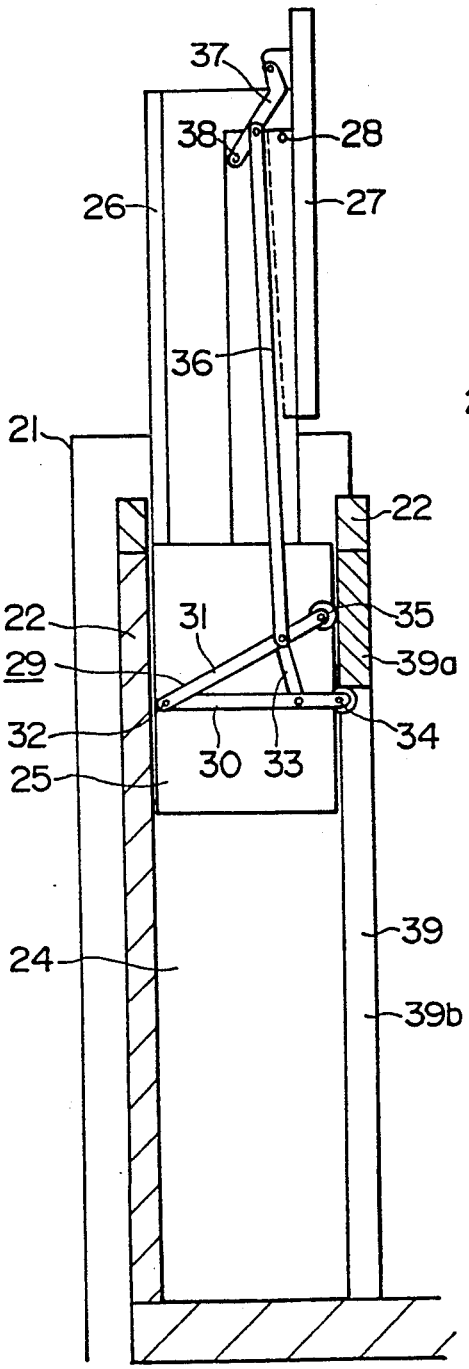
FIG. 12 and FIG. 13 are a vertical sectional side view of the apparatus, particularly illustrating a raising/lowering unit is increasingly raised up.
Figure 13:
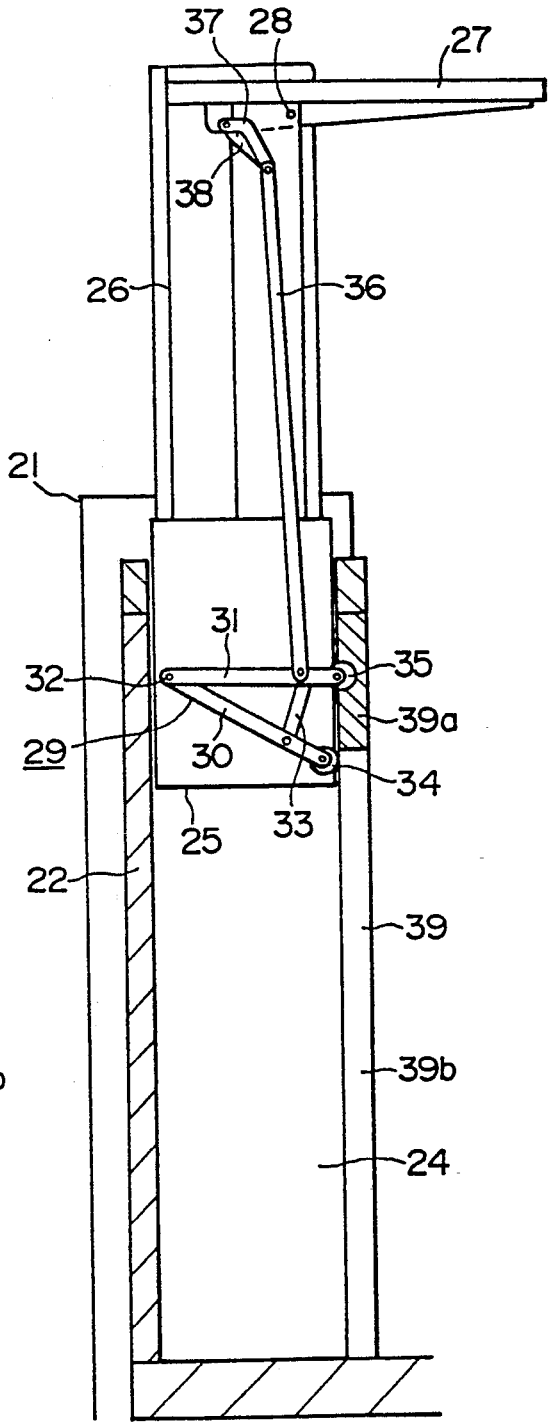
Figure 14:
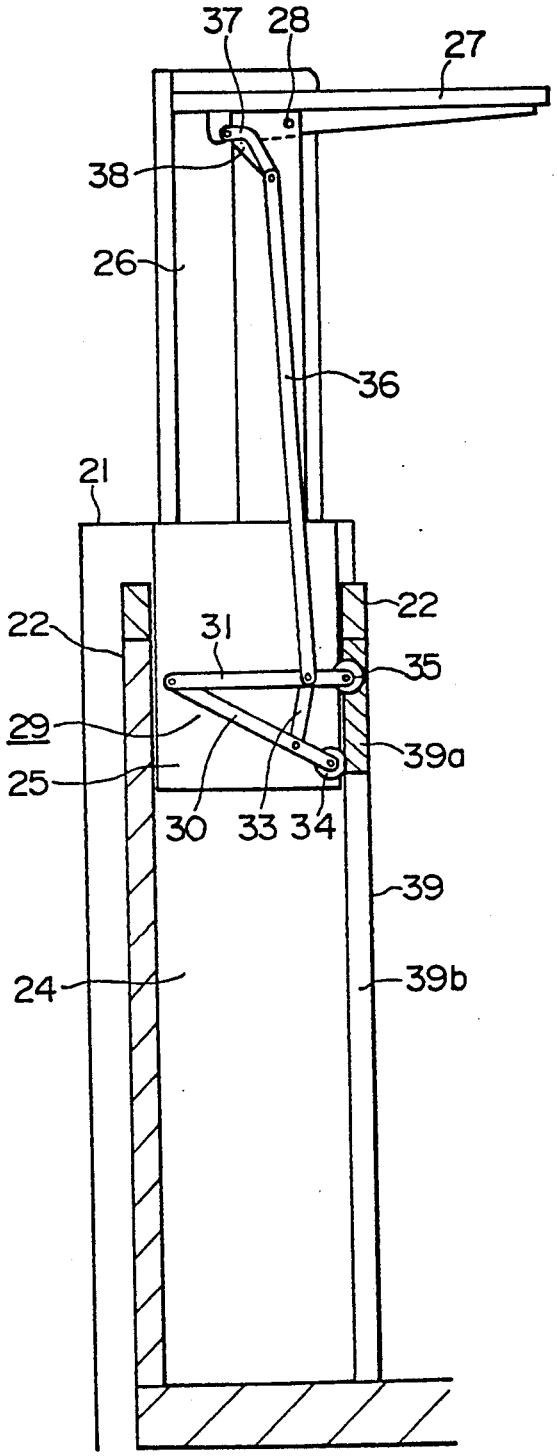
FIG. 14 is a vertical sectional side view of the apparatus, particularly illustrating that the tables assume a horizontal attitude.

When the tables 26 are to be raised up above the floor surface of the floor platform 21 from the foregoing positional state to assume a raised-up attitude, the raising/lowering unit 25 is first activated to be raised up in the table accommodating chamber 24. As the raising/lowering unit 25 is raised up, the rollers 34 and 35 of both the arms 30 and 31 are raised up along both the cam guide rails 39 and 40. When the tables 26 reach the position in the vicinity of the upper end of the table accommodating chamber 24 where they are raised up above the floor surface of the floor platform 21, the roller 34 of the first arm 30 comes in contact with the lower end of the projection surface 39*a* of the first cam guide rail 39 and the rollers 35 of the second arms 31 reach the stepped portions 40*a* of the second cam guide rails 40, as shown in FIG. 12. As the raising/lowering unit 25 is raised up further, the roller 34 of the first arm 30 climbs on the projection surface 39*a* of the first cam guide rail 39 causing the first arm 30 to turn about the shaft 32 in the downward direction, whereby the second arms 31 are likewise turned via the joint lever 33 until the rollers 35 at the foremost ends of the second arms 31 are received in the recessed surfaces 40*c* of the second cam guide rails 40. At the same time, the connecting rod 36 which has been connected to the second arms 31 is pulled in the downward direction so that the first lever 37 and the second lever 38 pivotally connected to the upper end of the connecting rod 36 are pulled down. This causes the table plate 27 to turn about the shaft 28 in the anticlockwise direction to assume a horizontal attitude so that the table 16 is normally assembled, as shown in FIG. 13. Subsequently, when the raising/lowering unit 25 is raised up to the upper end surface of the table accommodating chamber 24, the roller 34 of the first arm 30 climbs on the projection surface 39*a* of the first cam guide rail 39, while the rollers 35 of the second rams 31 are received in the recessed surfaces 40*c* of the second cam guide rails 40. Thus, as shown in FIG. 14, the table 26 assumes a correct raised-up attitude while the table plate 27 is maintained in the horizontally oriented state.

When the tables 26 are to be accommodated in the table accommodating chamber 24 to assume an accommodated attitude, the raising/lowering unit 25 is lowered in the opposite direction to the aforementioned one, causing both the arms 30 and 31 to be automatically restored to the original accommodated positions shown in FIG. 8.

As described above with respect to the two preferred embodiments, according to the present invention, the raising/lowering unit includes a link mechanism which is actuated by contact of rollers with cam guide rails and displacement of the rollers along the cam guide rails so that chairs, table or the like mounted on the raising/-lowering unit are automatically assembled while assuming a raised-up attitude or they are downwardly folded and accommodated in the furniture accommodating chamber while assuming an accommodated attitude. Thus, there is no need of performing complicated operations so as to set an operative attitude of each furniture, and moreover, furnitures can be assembled and disassembled at a high operational efficiency with the aid of the apparatus of the present invention which is simple in structure and has excellent rigidity. In addition, there is no need of separately arranging a complicated actuator for inclining chairs or the like. Conclusively, the present invention can provide an apparatus for setting an operative attitude to be assumed by each furniture to be accommodated in a furniture accommodating chamber of a furniture raising/lowering type floor equipment wherein the apparatus is simple in structure and has excellent rigidity.

While the present invention has been described above with respect to two preferred embodiments thereof, it should of course be understood that the present invention should not be limited only to these embodiments but various changes or modifications may be made without departure from the scope of the present invention as defined by the appended claims.

What is claimed is:

1. An apparatus for setting an operative attitude to be assumed by a piece of furniture in a furniture accommodating chamber of a furniture raising/lowering type floor equipment, comprising;

a raising/lowering unit vertically displaceably accommodated in said furniture accommodating chamber and having an array of furniture mounted via rods so as to allow said furniture to assume a raised-up attitude or an accommodated attitude, first and second cam guide rails arranged in said furniture accommodating chamber to stand upright therein so as to assure that said furniture firmly maintains a raised-up attitude or an accommodated attitude, and a triangle link mechanism having a first link, a second link and third link operatively associated with said raising/lowering unit and operatively connected to said furniture via said rods so as to enable said furniture to assume a raised-up attitude or an accommodated attitude.

2. The apparatus as claimed in claim 1, wherein said rods are support rods for mounting said furniture on said raising/lowering unit, and said triangular link mechanism comprises said first link integrated with a lower end of each support rod having a piece of furniture mounted thereon and including a roller at a foremost end thereof, said third links pivotally connected to said second link and including rollers at the foremost ends thereof, said third links being adapted to turn about a shaft transversely projecting from said raising/lowering unit at the intermediate positions thereof.

3. The apparatus as claimed in claim 2, wherein as said raising/lowering unit is raised up in said furniture accommodating chamber, said third links turn about said shaft transversely projecting from said raising/lowering unit, whereby said support rod rearwardly turns about a shaft located at the intermediate position thereof via said second link and said first link until each piece of furniture assumes an inclined state.

4. The apparatus as claimed in claim 1, wherein said first cam guide rail has an upper end and serves as a main cam guide rail and includes an inclined surface in the vicinity of the upper end thereof, a projection surface extending upward of said inclined surface and a recessed surface extending downward of said inclined surface, whereas each of said second cam guide rails serves as an auxiliary cam guide rail and includes an inclined surface substantially corresponding to said inclined surface of said first cam guide rail, a projection surface extending downward of said inclined surface and a recessed surface extending upward of said inclined surface.

5. The apparatus as claimed in claim 3, wherein said first cam guide rail is located in alignment with said first link integrated with the lower end of each support rod having a piece of furniture mounted thereon and said second cam guide rails are located in alignment with said third links, whereby when said furniture is not in use, the respective pieces of furniture are vertically folded and accommodated in said furniture accommodating chamber, and which include a roller at the foremost end of said first link received in said recessed surface of said first cam guide rail and said rollers at the foremost ends of said third links are engaged with said projection surfaces of said second cam guide rails so as to enable the respective furniture to maintain an accommodated attitude, whereas when they are in use said furniture is unfolded and stands upright on the floor surface of a building while said roller of said first lever is engaged with said projection surface of said first cam guide rail and said rollers of said third links are received in said recessed surfaces of said second cam guide rails so as to enable the respective furniture to maintain an accommodated attitude, whereas when in use said furniture is unfolded and stands upright on the floor surface of a building while said roller of said first lever is engaged with said projection surface of said first cam guide rails and said rollers of said third links are received in said recessed surfaces of said second cam guide rails so as to enable the respective pieces of furniture to maintain a raised-up attitude.

6. An apparatus for setting an operative attitude to be assumed by furniture stored in a furniture accommodating chamber of a furniture raising/lowering type floor equipment, comprising;

a raising/lowering unit vertically displaceably accommodated in said furniture accommodating chamber and having an array of furniture mounted thereon so as to allow said furniture to assume a raised-up attitude or an accommodated attitude, first and second cam guide rails arranged in said furniture accommodating chamber while standing upright therein so as to assure that said furniture firmly maintains a raised-up attitude or an accommodated attitude, and a triangular link mechanism operatively associated with said raising/lowering unit and operatively connected to said furniture via connecting rods so as to enable said furniture to assume a raised-up attitude or an accommodated attitude.

7. The apparatus as claimed in claim 6, wherein said triangular link mechanism comprises first links having foremost ends, said links turnably arranged to turn about a shaft transversely projecting from said raising/-lowering unit and including rollers at the foremost ends thereof, a second link turnably arranged below said first links to turn about said shaft and including a roller at the foremost end thereof and a third link bridged between said first links and said second link to serve as a joint link, the upper end of said third link being pivotally connected to said lower end of each said connecting rod for each table at the intermediate positions of said first links where said third link is pivotally connected to said first links.

8. The apparatus as claimed in claim 7, wherein said first cam guide rail serves as a main cam guide rail and includes a projection surface in the vicinity of the upper end thereof, a stepped portion positionally coinciding with the lower end of said projection surface and a recessed surface extending downward of said stepped portion, whereas each of said second cam guide rails serves as an auxiliary cam guide rail and includes a recessed surface in the vicinity of the upper end thereof, a stepped portion positionally coinciding with the lower end of said recessed surface and a projection surface extending downward of said stepped portion.

9. The apparatus as claimed in claim 8, wherein said furniture is tables and said first cam guide rail is located in alignment with said second link and said second cam guide rails are located in alignment with said first links, whereby when said tables each including a table plate are not in use, the respective table plates are vertically folded and accommodated in said furniture accommodating chamber while said rollers at the foremost ends of said first links are engaged with said projection surfaces of said second cam guide rails and said roller at the foremost end of said second link is received in said recessed surface of said first cam guide rail so as to enable the respective tables to maintain an accommodated attitude, whereas when they are in use, the respective table plates are unfolded with the aid of said connecting rod and the respective tables stand upright on the floor surface of a building while said rollers of said first links are received in said recessed surfaces of said second cam guide rails and said roller of said second link is engaged with said projection surface of said first cam guide rail so as to enable the respective tables to maintain a raised-up attitude.

10. The apparatus as claimed in claim 8, wherein said piece of furniture is a table having a table plate and as said raising/lowering unit is raised up in said furniture accommodating chamber, said first links and said second link turn about said shaft transversely projecting from said raising/lowering unit, whereby said connecting rod is increasingly raised up via said third link of which upper end positionally coincides with selected positions of said first links until the respective table plate assumes a horizontal orientation by turning movement thereof about a shaft transversely projecting from each table, said turning movement being achieved by a first lever of which one end is pivotally connected to the upper end of said connecting rod and of which said lower end is pivotally connected to the base end of said table plate, in cooperation with a second lever end of which one end is pivotally connected to the upper end of said connecting rod and of which said lower end is pivotally connected to the upper end of a main body of said table.

* * * * *